US007753686B2

(12) United States Patent
Kim et al.

(10) Patent No.: US 7,753,686 B2
(45) Date of Patent: Jul. 13, 2010

(54) VELCRO CONNECTOR

(75) Inventors: Baesun Kim, Daejeon (KR); Yongki Son, Daejeon (KR); John Sunwoo, Daejeon (KR); Hyuntae Jeong, Daejeon (KR); Ilyeon Cho, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 12/553,479

(22) Filed: Sep. 3, 2009

(65) Prior Publication Data

US 2010/0075511 A1 Mar. 25, 2010

(30) Foreign Application Priority Data

Sep. 22, 2008 (KR) ..... 10-2008-0092538

(51) Int. Cl.
*H01R 33/00* (2006.01)

(52) U.S. Cl. ..... 439/37; 224/675; 439/930

(58) Field of Classification Search ..... 439/37, 439/930; 2/102, 253, 247; 224/675
See application file for complete search history.

(56) References Cited

U.S. PATENT DOCUMENTS 4,191,950 A * 3/1980 Levin et al. ..... 340/604
4,239,046 A * 12/1980 Ong ..... 600/391
4,982,885 A * 1/1991 Severson et al. ..... 224/675
5,388,740 A * 2/1995 Garland ..... 224/675
5,622,346 A * 4/1997 Story, Jr. ..... 248/311.2
5,693,006 A * 12/1997 Slautterback ..... 602/19
6,279,804 B1 * 8/2001 Gregg ..... 224/675
6,697,262 B2 * 2/2004 Adams et al. ..... 361/785
2005/0066401 A1 * 3/2005 Feher ..... 2/2.5

FOREIGN PATENT DOCUMENTS

JP 7006804 A 1/1995
KR 1020020029095 A 4/2002
KR 1020080071299 A 8/2008

* cited by examiner

*Primary Examiner*—Neil Abrams
*Assistant Examiner*—Phuong Nguyen
(74) *Attorney, Agent, or Firm*—Ladas & Parry LLP

(57) ABSTRACT

The present invention relates to a velcro connector, which uses a hook of a velcro tape attached to a garment, etc. and a loop to transfer electric signals by being electrically connected upon coupling the hook and the loop. With the present invention, the difficulty of the line connection upon implementing electronic circuits on a garment can be solved by providing an integrated connector rather than separately mounting a mechanical connector on a garment. Therefore, it makes it possible to easily implement a wearable computer by using an integrated connector on a garment, etc. In addition, a plurality of electronic circuits mounted on a garment, etc. and the existing electronic devices are freely connected to each other by providing the connector that can be easily separated and coupled, thereby making it possible to increase user convenience.

11 Claims, 6 Drawing Sheets

(a)

(b)

VELCRO CONNECTOR

RELATED APPLICATIONS

The present application claims priority to Korean Patent Application Serial Number 10-2008-0092538, filed on Sep. 22, 2008, the entirety of which is hereby incorporated by reference.

BACKGROUND OF THE INVENTION

1. Field of the Invention

The present invention relates to a velcro connector, and in particular, a velcro connector that is mounted on a garment to transfer electric signals and easily connects to an external circuit module or an external line.

2. Description of the Related Art

Recently, research and development of conductive fibers capable of conducting electricity while maintaining the characteristics of fibers have been progressed. Further, the already developed conductive fibers have been utilized to manufacture a garment for measuring physiological signals in the field of digital garment and health care.

Herein, in order to implement a communication line for communicating with a garment by using the conductive fibers or implement simple electronic circuits, contacts should be formed in the middle of the conductive fibers to connect with the conductive fibers. As methods according to the related art in order to achieve this, there is a method of manufacturing a dedicated connector by connecting a snap fastener or a conductive contact pad using soldering, conductive adhesive, embroidery, etc. As another method, there is a method of manufacturing a garment so as not to generate the connection contacts.

However, currently used methods for connecting the contacts of the conductive fibers have several disadvantages. For example, the method using a snap fastener scheme, in which the snap fastener holds a coupling force by using a magnet, it has an advantage in that the coupling can be easily performed. However, the snap fastener is appropriate to form about only two contacts, not a plurality of contacts on a garment.

Meanwhile, a method for forming contact pads on a garment and attaching them thereto by soldering or conductive adhesives or connecting them thereto by embroidery should be removed from a garment composed of conductive yarns. As a result, the contact pads should be separated or recoupled, if necessary, which is difficult to perform. In addition, in the case of a method for manufacturing an integral connector, an existing PCB connector should be fixed on a stable plate, however, it is difficult to fix the PCB connector on a garment and the connecting part is easily separated due to motion. Therefore, in order to use the existing PCB connector, the PCB should be used at the connector fixing portion or there is a need to develop a connector that can meet the following requirements.

When a method that manufactures a garment without contacts, a simple electric circuit such as a communication line can be implemented by seamlessly manufacturing a garment from beginning to end. However, in order to ensure a seam does not occur during the manufacturing process, a dedicated loom and knitting machine needs to be developed.

Meanwhile, Korea Unexamined Patent Application Publication No. 2008-0071299 discloses a velcro connector using a velcro tape. Herein, the velcro connector is weaved by using the same area of where a hook of the velcro tape and a loop part as a connecting part corresponding to the connecting part when weaving the textile, which is a conductive yarn, such that it transfers electric signals through the connecting part upon connecting the hook and the loop. The velcro connector uses one area, which is where the connecting part of the hook and the connecting part of the loop are coupled to each other, as one line.

In this case, a user should visually ensure the surfaces between the connecting part of the hook and the connecting part of the loop, etc., are accurately coupled a, such that the velcro connector can function as a connector. When the length of the velcro connector is formed to be long, the user should visually check the surfaces of the connecting part by matching each individual area, in order to make the signal line be connected, thus making it possible to use the signal line of the velcro connector. When the user does not confirm the surfaces of the connecting part provided in the hook and the loop and roughly couples them, a disconnection or a short with adjacent lines may occur.

In addition, the velcro connector forms some area of the hook and the loop as the conductive yarn in order to transfer the electric signals, but since the connecting part is the portion that is weaves together the hook and the loop, in order to transfer electric signals, the connecting part should maintain some degree of length or width, such that the number of lines is limited according to an area of the velcro tape. Thus, the number of connectable electric devices or circuit modules is also limited.

Moreover, since the velcro connector according to the related art does not propose the connecting method with the external line or the circuit module, a need exists for a more practical velcro connector.

SUMMARY OF THE INVENTION

It is an object of the present invention to provide an integrated velcro connector that can be easily separated and coupled from and to a garment, etc. in order to solve the problem connecting the signal line when implementing electronic circuits on a garment.

In addition, it is another object of the present invention to provide a velcro connector that can freely be connected with a plurality of electronic circuits mounted on a garment, etc. and the existing electronic devices or other connectors by providing a plurality of connecting terminals.

In order to achieve the above objects, there is provided a velcro connector according to the present invention, including: a hook connector that includes a hook, a hook connector body having the hook coupled to the lower portion thereof, a plurality of connecting terminals disposed on the hook connector body to input and output electric signals, and a plurality of hook connector connecting parts electrically connected by wires to the plurality of connecting terminals and having a conductive hook disposed on the lower portion thereof; and a loop connector that includes a loop, a loop connector body having the loop coupled to the upper portion thereof, a plurality of connecting terminals disposed on the loop connector body to input and output electric signals, and a plurality of loop connector connecting parts electrically connected by wires to the plurality of connecting terminals, formed at a position corresponding to the plurality of hook connector connecting parts, and having a conductive loop disposed on the upper portion thereof.

A portion of the hook is a conductive hook and a portion of the loop is a conductive loop.

In order to achieve the above objects, there is provided a velcro connector according to the present invention, including: a hook connector that includes a hook, a hook connector body having the hook coupled to the lower portion thereof, a plurality of connecting terminals disposed on the hook connector body to input and output electric signals, and a plurality of hook connector connecting parts electrically connected by wires to the plurality of connecting terminals, and a first signal connecting means of a conductive material connected to the plurality of hook connector connecting parts; and a loop connector that includes a loop, a loop connector body having the loop coupled to the upper portion thereof, a plurality of connecting terminals disposed on the loop connector body to input and output electric signals, and a plurality of loop connector connecting parts electrically connected by wires to the plurality of connecting terminals, and a second signal connecting means of a conductive material coupled to the plurality of loop connector connecting part and disposed at a position corresponding to the first signal connecting means.

The first signal connecting means is coupled to the hook connector connecting part in a vertical direction or a horizontal direction and the second signal connecting means is coupled to the loop connector connecting part in a vertical direction or a horizontal direction. In addition, the first signal connecting means is coupled to be protruded to the hook connector body and the second signal connecting means is coupled to be protruded to the loop connector body.

Further, in the hook, holes are formed at a position corresponding to the hook connector connecting part and in the loop, holes are formed at a position corresponding to the loop connector connecting part.

Meanwhile, a circuit module is coupled to one surface of the hook connector or the loop connector.

With the present invention, the difficulty of the line connection upon implementing electronic circuits on a garment can be solved by providing an integrated connector rather than separately mounting a mechanical connector on a garment. Therefore, it makes it possible to easily implement a wearable computer by an integrated connector on a garment, etc.

In addition, the plurality of electronic circuits mounted on a garment, etc. and the existing electronic devices or other connectors can be freely connected to each other by providing the plurality of connecting terminals in order to make the connection with the external line or the circuit module easy.

Moreover, the hook connector and the loop connector can be more firmly coupled by providing the signal connecting means connecting between the hook connector and the loop connector.

DETAILED DESCRIPTION OF THE PREFERRED EMBODIMENTS

Hereinafter, exemplary embodiment of the present invention will be described with reference to the accompanying drawings.

The present invention relates to a velcro connector using a hook of a velcro tape attached to a garment, etc. and a loop coupled to the hook.

Herein, the velcro connector is largely sorted into a hook connector that is attached to the hook to transfer electric signals and a loop connector that is attached to the loop to transfer electric signals. At this time, the velcro connector has a structure where the hook connector and the loop connector are electrically connected to each other upon coupling the hook and the loop.

Hereinafter, a configuration according to the embodiment will be described with reference to FIGS. 1 to 8.

Figure 1:
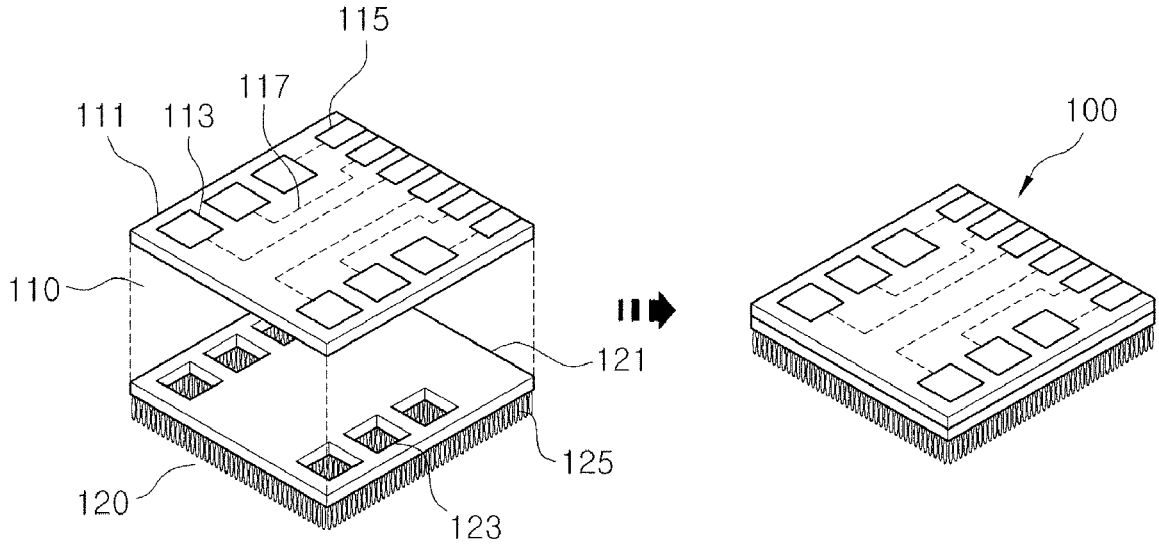
FIG. 1 is a perspective view for explaining a configuration of a hook connector according to a first embodiment of the present invention.

First, FIG. 1 is a diagram showing a configuration of a hook connector of the velcro connector according to a first embodiment of the present invention.

Referring to FIG. 1, a hook connector 100 according to the present invention is one that a connector part 110 and a hook part 120 are coupled to each other. In an embodiment of FIG. 1, the connector part 110 and the hook part 120 are separately provided for convenience of explanation. However, the hook connector 100 may be one where the connector part 110 and the hook part 120 are integrally formed.

First, the connector part 110 in the hook connector 100 includes a hook connector body 111, a hook connector connecting part 113, a connecting terminal 115, and a connecting line 117. The hook connector connecting part 113, the connecting terminal 115, and the connecting line 117 are disposed on the hook connector body 111. Further, the hook part 120 includes a hook body 121 and a hook 125 in a hook shape attached to the hook body. At this time, the hook part 120 is coupled to the lower portion of the hook connector body 111. In the present embodiment, although the hook part 120 is described by sorting into the hook body 121 and the hook 125 for convenience sake, the coupling form of the hook 125 and the hook body 121, that is, the hook part 120 itself may be called a hook.

The hook connector connecting part 113 is disposed in a predetermined area of the hook connector body 111. At this time, the hook connector connecting part 113 may be provided in plurality. Further, the hook connector connecting part 113 is electrically connected to the connecting terminal 115 to transfer the electric signals input through the connection terminal 115 to the loop connector or to output the electric signals applied from the loop connector to the outside through the connecting terminal 115.

At this time, the hook connector connecting part 113 is directly or indirectly connected to the connecting terminal 115. In the case of an indirect connection, they can be connected to each other by the connecting line 117. The connecting line 117 is a line that connects the hook connector connecting part 113 to the connecting terminal 115 and can be implemented by a yarn composed of a conductive material.

Meanwhile, the hook connector connecting part 113 can be implemented as a pad made of a conductive material, otherwise implemented using a non-conductive material in the case of using a separate first signal connecting means. Further, in the case of using the separate first signal connecting means, the hook body 121 can be formed with a hole 123 for inserting the first signal connecting means coupled by the hook connector connecting part 113. At this time, the shape and size of the hole 123 formed on the hook body 121 can be changed according to the connecting portion with the loop connector and omitted according to the connecting position. Therefore, the first signal connecting means contacts the loop connector through the hole on the hook body 121. The embodiment of the first signal connecting means will be described with reference to FIG. 3.

The connecting terminal 115 is a terminal connected to the external electric line and is implemented in the pad form of the conductive material and can thus be attached to the hook connector body 111. At this time, it is preferable that the connecting terminal 115 is disposed at the end of the hook connector body 111 so that it is easily connected to the external line. Of course, the state that the connecting terminal 115 is disposed only in one direction is shown in the drawing, but the embodiment is not limited thereto. Further, the connecting terminal 115 can also be disposed in two directions or in any direction. Therefore, the connecting terminal 115 of the corresponding hook connector 100 is connected to the connecting terminal of another hook connector by the external electric line, making it possible to connect the plurality of hook connectors 100 in series. Meanwhile, the connecting terminal 115 may be connected to a separately provided circuit module.

Figure 2:
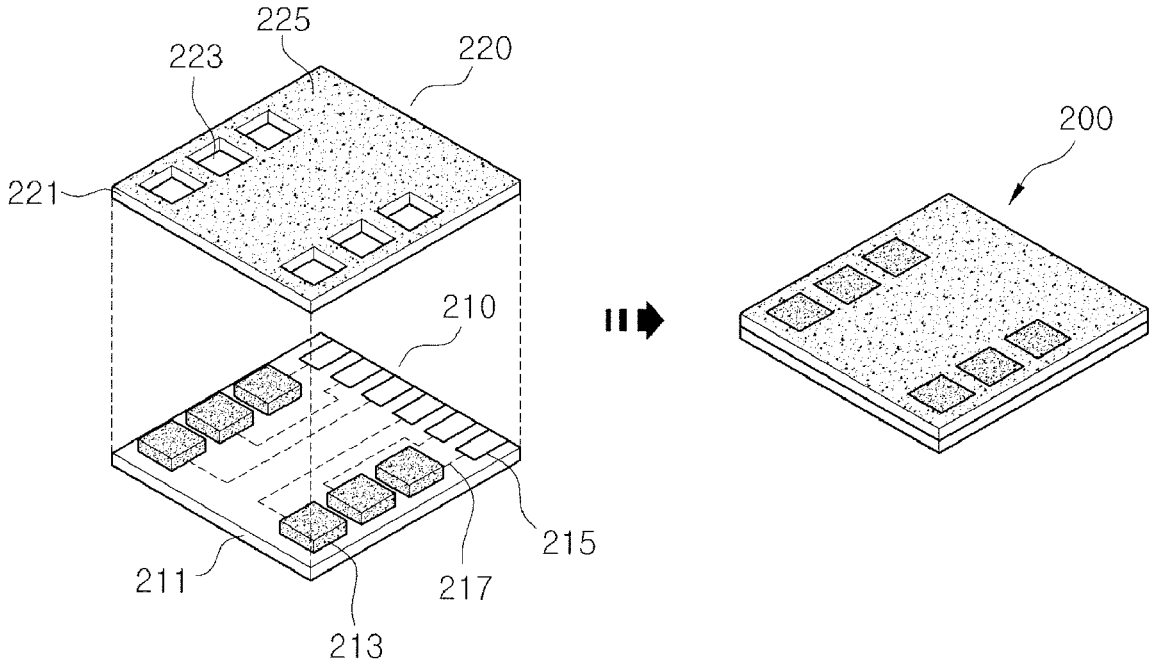
FIG. 2 is a perspective view for explaining a configuration of a loop connector according to a first embodiment of the present invention.

FIG. 2 shows a diagram showing a configuration of a loop connector of a velcro connector according to the present invention. Referring to FIG. 2, a loop connector 200 according to the present invention is one when a connector part 210 and a loop part 220 are coupled to each other. In an embodiment of FIG. 2, the connector part 210 and the look part 220 are separately provided for convenience of description. However, the looP connector 200 may be one when the connector part 210 and the hook part 220 are integrally formed.

First, the connector part 210 in the hook connector 200 includes a loop connector body 211, a loop connector connecting part 213, a connecting terminal 215, and a connecting line 217. The loop connector connecting part 213, the connecting terminal 215, and the connecting line 217 are disposed on the loop connector body 211. Further, the loop part 220 includes a loop body 221 and a loop 225 attached to the loop body 221 and coupled to the hook 125. At this time, the loop part 220 is coupled to the upper portion of the hook connector body 211. In the present embodiment, although the loop part 220 is described by sorting into the loop body 221 and the loop 225 for convenience sake, the coupling form of the loop 225 and the loop body 221, that is, the loop part 220 itself may be called a loop.

The loop connector connecting part 213 is disposed in a predetermined area of the loop connector body 211. At this time, the loop connector connecting part 213 may be provided in plurality. Further, the loop connector connecting part 213 is electrically connected to the connecting terminal 215 to transfer the electric signals input through the connection terminal 215 to the hook connector 100 or to output the electric signals applied from the hook connector 100 to the outside through the connecting terminal 215.

At this time, the loop connector connecting part 213 is directly or indirectly connected to the connecting terminal 215. In the case of indirect connection, they are connected to each other by the connecting line 217. The connecting line 217 is a line that connects the loop connector connecting part 213 to the connecting terminal 215 and can be implemented by yarn made of a conductive material.

Meanwhile, the loop connector connecting part 213 can be implemented as a pad made of a conductive material or a non-conductive material in the case of using a separate second signal connecting means. Further, in the case of using the separate second signal connecting means, the loop body 221 can be formed with a hole 223 for inserting the second signal connecting means coupled the loop connector connecting part 213. At this time, the shape and size of the hole 223 formed on the loop body 221 can be changed according to the connecting portion of the second signal connecting means and omitted according to the connecting position. Therefore, the second signal connecting means contacts the hook connector 100 through the hole on the hook body 121.

The second signal connecting means can be implemented in a conductive loop form as shown in FIG. 2 and the conductive loop may be provided in a form attached to the upper portion of the loop connector connecting part 213. Meanwhile, the second signal connecting means may be inserted and coupled in the loop connector connecting part 213 in a vertical direction. At this time, the second signal connecting means can be integrally connected with the loop connector body 213.

The connecting terminal 225 is a terminal connected to the external electric line and is implemented as the pad made of the conductive material and can thus be attached to the loop connector body 211. At this time, it is preferable that the connecting terminal 215 is disposed at the end of the loop connector body 211 so that it is easily connected to the external line. In an embodiment of FIG. 2, a direction where the connecting terminal 215 is provided is formed in the same direction as the connecting terminal 115 of the hook connector 100 of FIG. 1 to more easily describe the embodiment according to the present invention. However, in order to increase the efficiency of the connector, the connecting terminal 215 may be formed in an opposite direction to the connecting terminal 115 of the hook connector 100.

Also, the state that the connecting terminal 215 is disposed only in one direction is shown in the drawing, but the embodiment is not limited thereto. Further, the connecting terminal 215 can also be disposed in two directions or any direction. Therefore, the connecting terminal 215 of the corresponding loop connector 200 is connected to the connecting terminal of another loop connector by the external electric line, making it possible to connect the plurality of loop connectors 200 in series. Meanwhile, the connecting terminal 215 may be connected to a separately provided circuit module.

Figure 3:
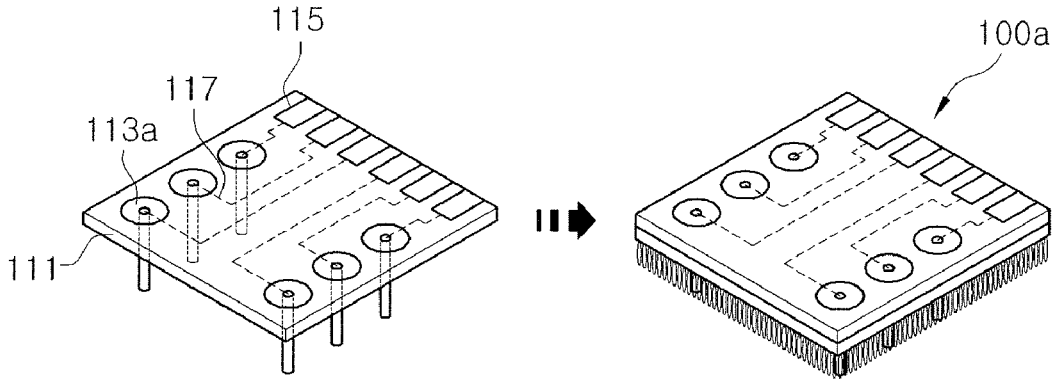
FIG. 3 is an exemplary view showing an embodiment of a first signal connecting means for a hook connector of FIG. 1.
Figure 3:
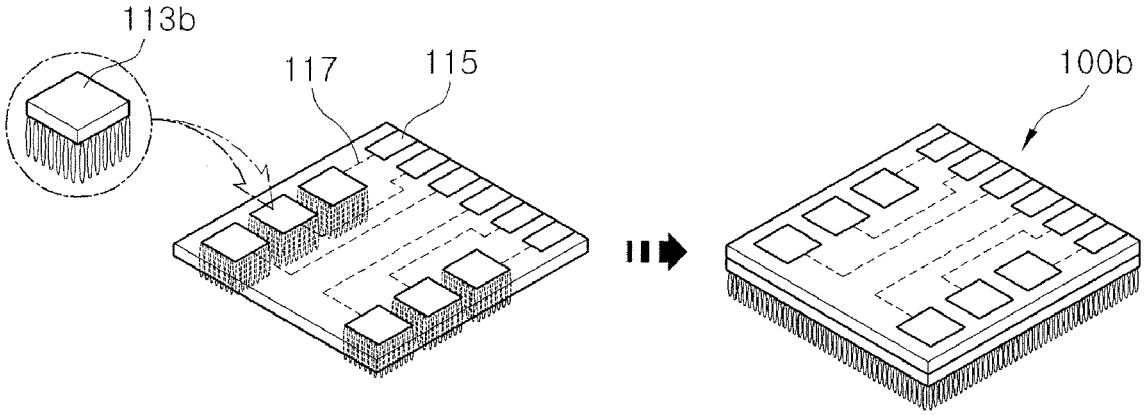

FIG. 3 shows an embodiment of the hook connector of the present invention. In detail, FIG. 3 shows an example that implements the different embodiment of the first signal connecting means in the hook connector.

First, in a hook connector 100*a* shown in FIG. 3(*a*), the hook connector connecting part 113 is provided with a first signal connecting means 113*a*, such as a button, a pin, etc. made of a conductive material, which is formed in a 'T'-letter shape. At this time, the first signal connecting means 113*a* may be integrally with the hook connector body 111 and inserted and coupled in the hook connector body 111 in a vertical direction.

Herein, the first signal connecting means 113*a* can be variously implemented to have a length of a predetermined value or more in a vertical direction the hook connector body 111 in 'I'-letter shape, 'ㄷ'-letter shape, etc. in addition to the 'T'-letter shape. Therefore, the first signal connecting means 113*a* contacts the second signal connecting means of the loop connector 200 upon coupling the hook 125 and the loop 225.

At this time, the first signal connecting means 113*a* is electrically connected to the connecting terminal 115 through the connecting line 117 and transfers the electric signals input through the connecting terminal 115 to the loop connector 200 or transfers the electric signals applied from the loop connector 200 to the connecting terminal 115. Of course, the first signal connecting means 113*a* man be directly connected to the connecting line 117 or may be connected to the connecting line 117 through the hook connector connecting part 113.

Meanwhile, a hook connector 110*b* shown in FIG. 3(*b*) includes the conductive hook as the first signal connecting means 113*b*, such that the hook connector 100*b* and the loop connector 200 can be electrically connected to each other upon coupling the hook and the loop. In other words, when coupling the hook 125 and the loop 225, the conductive hook is coupled to the second signal connecting means of the loop connector 200, that is, the conductive loop, such that the hoop connector 100*b* and the loop connector 200 are electrically connected to each other.

As such, the hook connector includes the first signal connecting means 113*a* and 113*b*, such that the hook connector and the loop connector can be more firmly connected. Also, even though the conductive hook or the conductive loop are not weaved together using the conductive yarn when manufacturing the velcro tape, the electric signals can be transferred between the hook connector and the loop connector by inserting a metallic pin, etc. after being manufactured.

Figure 4:
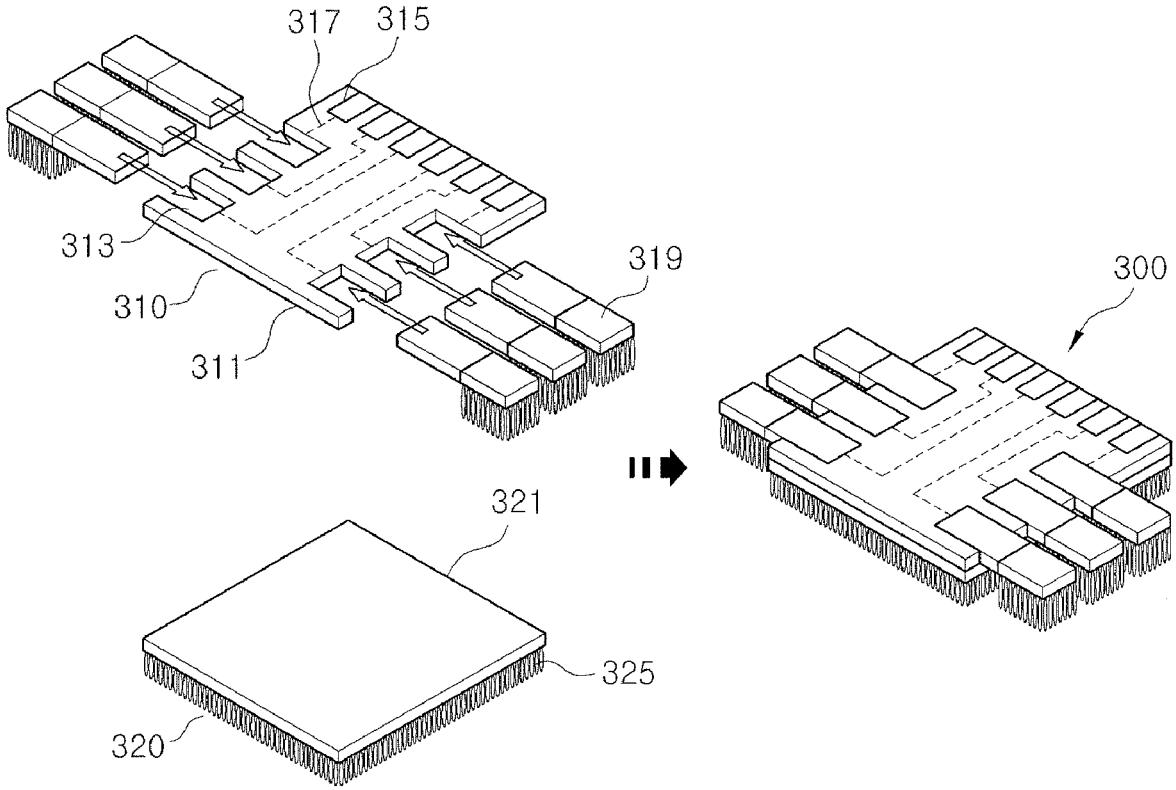
FIG. 4 is a perspective view for explaining a configuration of a hook connector according to a second embodiment of the present invention.

FIG. 4 shows a configuration of the hook connector of the velcro connector according to a second embodiment, wherein the first signal connecting means is formed to be removable to the hook connector body.

FIG. 4 shows an example that a first signal connecting means 319 uses a hook composed of a conductive material, but as shown in FIG. 3, the first signal connecting means 319 can be variously implemented to have a length of a predetermined value or more in a vertical direction of the hook connector body 311, such as a button, a pin, etc. of a conductive material formed in a 'T'-letter shape.

The hook connector connecting part 313 is formed as a groove to open one side thereof and a side end of the groove may be formed as a groove (not shown) or a protrusion (not shown) to facilitate the mounting of the first signal connecting means. Therefore, the first signal connecting means 319 can be detached and attached from and to the hook connector connecting part 313 in a horizontal direction. At this time, when the first signal connecting means 319 is mounted on the hook connector connecting part 313, the connecting terminal 315 is electrically connected to the first signal connecting means 319 by the connecting line 317.

The so formed connector part 310 is coupled to the hook part 320, thereby completing the hook connector 300 in another form. At this time, the first signal connecting means 319 is coupled to be protruded to the hook connector body 311.

Figure 5:
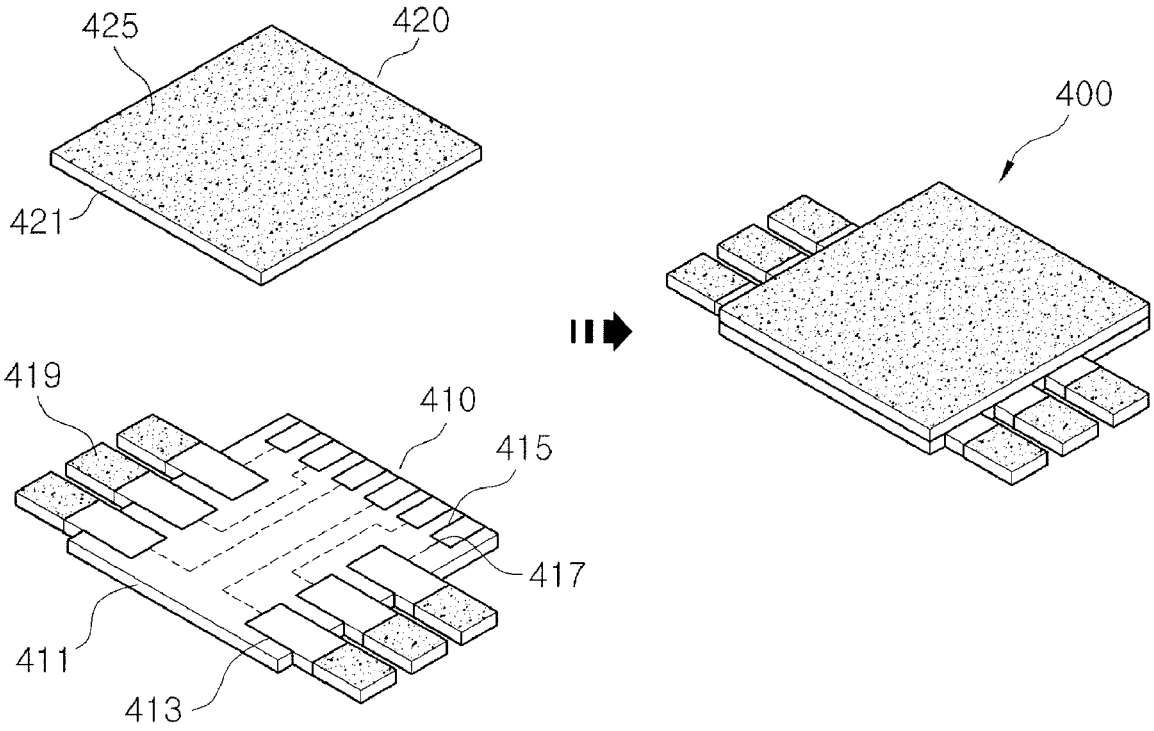
FIG. 5 is a perspective view for explaining a configuration of a loop connector according to a second embodiment of the present invention.

FIG. 5 shows a configuration of the loop connector of the velcro connector according to the second embodiment and shows the loop connector for coupling with the hook connector of FIG. 4.

A loop connector 400 separately includes a second signal connecting means 419 coupled to the first signal connecting means 319 of the hook connector 300 similar to the embodiment of FIG. 4, such that it is formed to be removable from a loop connector connecting unit 413 of a loop connector body 411. At this time, FIG. 5 shows an example that the conductive loop for coupling with the conductive hook used as the first signal connecting means 319 of FIG. 4 is used as the second signal connecting means 419, but it may use a means corresponding to the implementation form of the first signal connecting means 319 of FIG. 4.

In FIG. 5, the hook connector connecting part 413 is formed as a groove to open one side thereof and a side end of the groove may be formed with a groove (not shown) or a protrusion (not shown) to facilitate the mounting of the second signal connecting means 419. Therefore, the second signal connecting means 419 can be detached and attached from and to the loop connector connecting part 413 in a horizontal direction. At this time, when the second signal connecting means 419 is mounted on the loop connector connecting part 413, the connecting terminal 415 is electrically connected to the second signal connecting means 419 by the connecting line 417.

The so formed connector part 410 is attached to the loop part 420, thereby completing the loop connector 400 in another form. At this time, the second signal connecting means 419 is coupled to be protruded to the loop connector body 411.

Consequently, when coupling the hook and the loop of the velcro connector, the conductive hook is mounted so as to protrude on the hook connector body 311 and the conductive loop is also mounted so as to protrude on the loop connector body 411 are coupled to each other, thereby transferring the electric signals between the hook connector 300 and the loop connector 400 therethrough.

Figure 6:
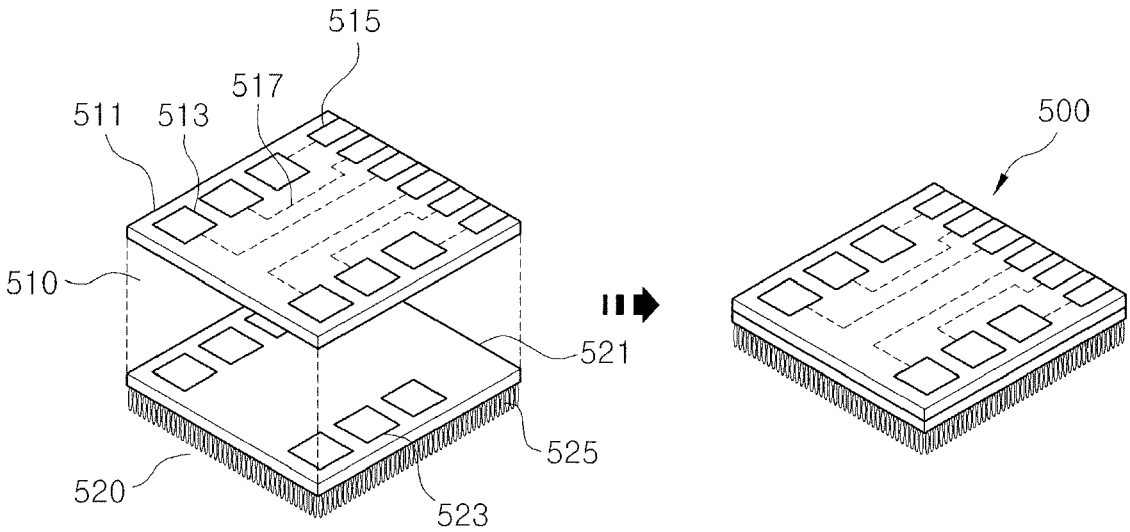
FIG. 6 is a perspective view for explaining a configuration of a hook connector according to a third embodiment of the present invention.

FIG. 6 is a diagram showing a configuration of the hook connector of the velcro connector according to a third embodiment of the present invention.

Referring to FIG. 6, a hook connector 500 according to the present invention is one when a connector part 510 and a hook part 520 are coupled to each other. In an embodiment of FIG. 6, the connector part 510 and the hook part 520 are separately provided for convenience of description. However, the hook connector 500 may be one when the connector part 510 and the hook part 520 are integrally formed.

First, the connector part 510 in the hook connector 500 includes a hook connector body 511, a hook connector connecting part 513, a connecting terminal 515, and a connecting line 517. The hook connector connecting part 513, the connecting terminal 515, and the connecting line 517 are disposed on the hook connector body 511.

The hook connector connecting part 513 is disposed in a predetermined area of the hook connector body 511. At this time, the hook connector connecting part 513 may be provided in plurality. Further, the hook connector connecting part 513 is electrically connected to the connecting terminal 515 to transfer the electric signals input through the connection terminal 515 to the loop connector or to output the electric signals applied from the loop connector to the outside through the connecting terminal 515.

At this time, the hook connector connecting part 513 is directly or indirectly connected to the connecting terminal 515. In the case of indirect connection, they are connected to each other by the connecting line 517. The connecting line 517 is a line that connects the hook connector connecting part 513 to the connecting terminal 515 and can be implemented by yarn made of a conductive material. At this time, the hook connector connecting part 513 can be implemented as a pad made of a conductive material.

The connecting terminal 515 is a terminal connected to the external electric line and is implemented as a pad made of a conductive material and can thus be attached to the hook connected body 511. At this time, it is preferable that the connecting terminal 515 is disposed at the end of the hook connector body 511 so that it is easily connected to the external line. Of course, the state that the connecting terminal 515 is disposed only in one direction is shown in the drawing, but the embodiment is not limited thereto. Therefore, the connecting terminal 515 can further be disposed in two directions or any direction. Therefore, the connecting terminal 515 of the hook connector 500 is connected to the connecting terminal of another hook connector by the external electric line, making it possible to connect the plurality of hook connectors 500 in series. Meanwhile, the connecting terminal 515 may be connected to a separately provided circuit module.

The hook part 520 includes a hook body 521 and a hook 525 in a hook shape attached to the hook body. At this time, the hook part 520 is coupled to the lower portion of the hook connector body 511.

Meanwhile, in the hook body 521, the conductive pad 523 is provided at a position corresponding to the hook connector connecting part 513 of the connector part 510 and the conductive hook is attached to the lower portion of the conductive pad 523. At this time, the conductive hook is electrically connected to the loop connector connecting part of the loop connector. Therefore, the conductive pad 523 contacts the hook connector connecting part 513 upon coupling the connector part 510 and the hook part 520 to transfer the electric signals input through the connecting terminal 515 to the loop connector through the conductive hook. Likewise, the electric signals input through the loop connector are transferred to the hook connector connecting part 513 through the conductive hook and the conductive pad 523 of the hook body 521.

Figure 7:
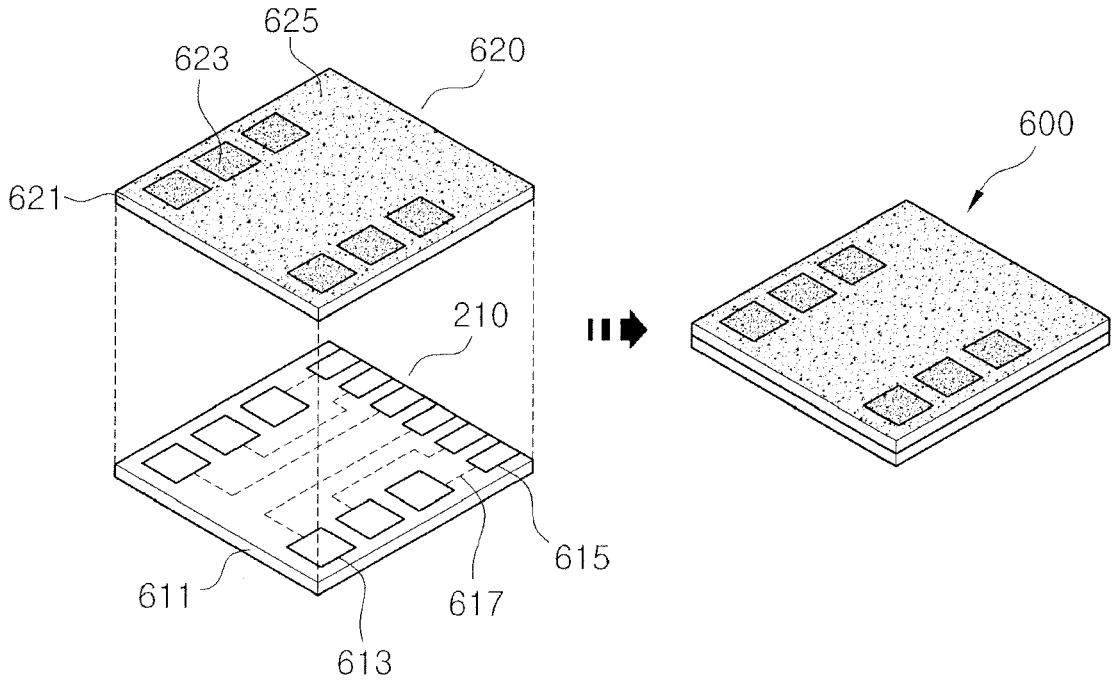
FIG. 7 is a perspective view for explaining a configuration of a loop connector according to a third embodiment of the present invention.

FIG. 7 is a diagram showing a configuration of a loop connector of a velcro connector according to a third embodiment of the present invention.

Referring to FIG. 7, a hook connector 600 according to the present invention is one when a connector part 610 and a loop part 620 are coupled to each other. In an embodiment FIG. 7, the connector part 610 and the loop part 620 are separately provided for convenience of description. However, the loop connector 600 may be one when the connector part 610 and the loop part 620 are integrally formed.

First, the connector part 610 in the loop connector 600 includes a loop connector body 611, a loop connector connecting part 613, a connecting terminal 615, and a connecting line 617. The loop connector connecting part 613, the connecting terminal 615, and the connecting line 617 are disposed on the loop connector body 611.

The loop connector connecting part 613 is disposed in a predetermined area of the loop connector body 611. At this time, the loop connector connecting part 613 may be provided in plurality. Further, the loop connector connecting part 613 is electrically connected to the connecting terminal 615 to transfer the electric signals input through the connection terminal 615 to the hook connector 500 or to output the electric signals applied from the hook connector 500 to the outside through the connecting terminal 615.

At this time, the loop connector connecting part 613 is directly or indirectly connected to the connecting terminal 615. In the case of indirect connection, they are connected to each other by the connecting line 617. The connecting line 617 is a line that connects the loop connector connecting part 613 to the connecting terminal 615 and can be implemented by a yarn composed of a conductive material, etc. At this time, the loop connector connecting part 613 can be implemented in a pad form of a conductive material.

The connecting terminal 615 is a terminal connected to the external electric line and is implemented in a pad form of a conductive material and can thus be attached to the loop connector body 611. At this time, it is preferable that the connecting terminal 615 is disposed at the end of the loop connector body 611 so that it is easily connected to the external line. Of course, the connecting terminal 615 disposed only in one direction is shown in the drawing, but the embodiment is not limited thereto. Therefore, the connecting terminal 615 can also be disposed in two directions or any direction. Therefore, the connecting terminal 615 of the loop connector 600 is connected to the connecting terminal of another loop connector by the external electric line, making it possible to connect the plurality of loop connectors 600 in series. Meanwhile, the connecting terminal 615 may be connected to a separately provided circuit module.

The loop part 620 includes a loop body 621 and a loop 625 attached to the loop body 621 and coupled to the hook 525. At this time, the loop part 620 is coupled to the upper portion of the loop connector body 611.

Meanwhile, in the loop body 621, the conductive pad is provided at a position corresponding to the loop connector connecting part 613 of the connector part 610 and the conductive loop 623 is attached to the upper portion of the conductive pad. At this time, the conductive loop is electrically connected to the conductive hook of the hook connector 500.

Therefore, the conductive pad of the loop body 621 contacts the loop connector connecting part 613 upon coupling the connector part 610 and the loop part 620 to transfer the electric signals input through the connecting terminal 615 to the hook connector 500 through the conductive loop 623. Likewise, the electric signals input through the hook connector 500 are transferred to the loop connector connecting part 613 through the conductive loop 623 and the conductive pad of the loop body 621.

Figure 8:
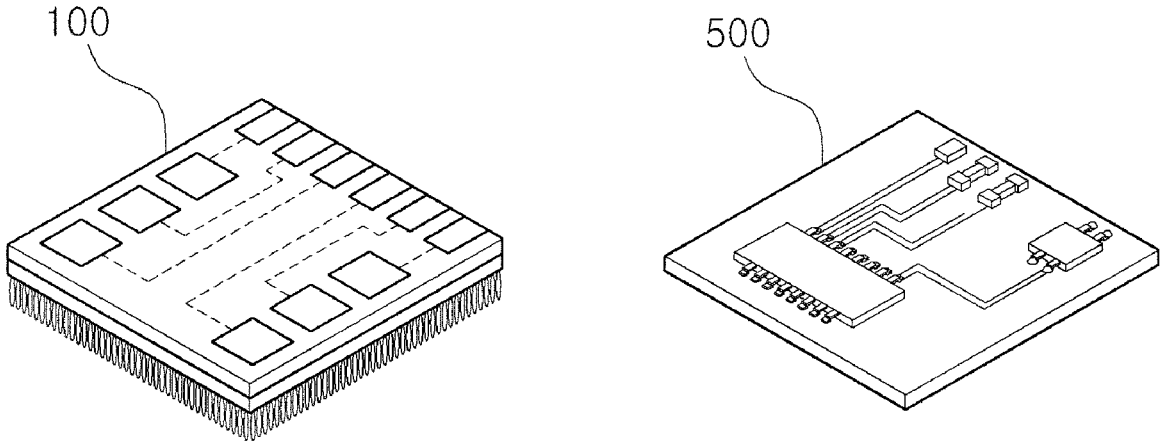
FIG. 8 is a perspective view showing an embodiment of a velcro connector according to the present invention.

FIG. 8 is a diagram for explaining a configuration of the velcro connector according to one embodiment of the present invention and shows the separate circuit module connected to the hook connector.

In other words, the connecting terminal 115 of the hook connector 100 is connected to a separate circuit module 700 by the external electric line. Therefore, in the state when the hook 125 and the loop 225 of the velcro connector are coupled to each other, if the electric signals from the circuit module 700 connected to the hook connector 100 are input, the hook connector 100 transfers the electric signals input through the input terminal 115 to the loop connector connecting part 213 of the loop connector 200 through the hook connector connecting part 113. At this time, the loop connector 200 outputs the electric signals applied to the loop connector connecting part 213 to the outside through the connecting terminal 215.

In FIG. 8, an example that the circuit module 700 is connected to the hook connector 100 according to the first embodiment is described, but the circuit module can be connected to the hook connectors 300 and 500 according to the second embodiment and the third embodiment. Further, it is natural that the circuit module 700 may be connected to the loop connectors 200, 400, and 600 according to the first embodiment, the second embodiment, and the third embodiment.

When the plurality of hook connectors 100 and loop connectors 200 are provided, the electric signals output from the loop connector 200 are input through the input terminal of other loop connectors and output to the outside through the hook connector electrically connected to the corresponding loop connector. Herein, the plurality of hook connectors 100 and loop connectors 200 are electrically connected to each other by embroidered yarn made of a conductive material.

At this time, when the velcro connector is generally attached to a garment, the hook is attached to one side and the loop is attached to the other side, thereby electrically connecting among the hook connectors and electrically connecting among the loop connectors. When the hook and the loop are alternately attached to one side, it is natural that the hook connector and the loop connector attached to one side can be electrically connected to each other.

Therefore, when the velcro connector according to the present invention is attached to a garment, etc., it is easy to couple and separate the velcro connector to and from a garment and the circuit module can be connected through the contacts of the velcro connector. Further, it is possible to effectively transfer the electric signals from the wearable computer, etc. As an example, there may be a case of electrically connecting electronic circuits mounted on a garment and electric circuits mounted on gloves, a case of electrically connecting each garment when a person wears several-layered garments, or a case of electrically connecting the existing PCB board to a garment. In addition to these, it can be implemented in various ways.

As described above, the velcro connecter according to the present invention is not limited to the configuration and method of the foregoing embodiments, but the embodiments may be configured by selectively combining all the embodiments or some of the embodiments so that various modifications can be made.

What is claimed is:

1. A velcro connector, comprising:

a hook connector that includes a hook, a hook connector body having the hook coupled to the lower portion thereof, a plurality of connecting terminals disposed on the hook connector body to input and output electric signals, and a plurality of hook connector connecting parts electrically connected by wires to the plurality of connecting terminals through wires and having a conductive hook disposed on the lower portion thereof; and a loop connector that includes a loop, a loop connector body having the loop coupled to the upper portion thereof, a plurality of connecting terminals disposed on the loop connector body to input and output electric signals, and a plurality of loop connector connecting parts electrically connected by wires to the plurality of connecting terminals, formed at a position corresponding to the plurality of hook connector connecting parts, and having a conductive loop disposed on the upper portion thereof.

2. The velcro connector according to claim 1, wherein a portion of the hook is a conductive hook.

3. The velcro connector according to claim 1, wherein a portion of the loop is a conductive loop.

4. The velcro connector according to claim 1, wherein a circuit module is coupled to one surface of the hook connector or the loop connector.

5. A velcro connector, comprising:

a hook connector that includes a hook, a hook connector body having the hook coupled to the lower portion thereof, a plurality of connecting terminals disposed on the hook connector body to input and output electric signals, and a plurality of hook connector connecting parts electrically connected by wires to the plurality of connecting terminals, and a first signal connecting means of a conductive material connected to the plurality of hook connector connecting parts; and a loop connector that includes a loop, a loop connector body having the loop coupled to the upper portion thereof, a plurality of connecting terminals disposed on the loop connector body to input and output electric signals, and a plurality of loop connector connecting parts electrically connected by wires to the plurality of connecting terminals, and a second signal connecting means of a conductive material coupled to the plurality of loop connector connecting part and disposed at a position corresponding to the first signal connecting means.

6. The velcro connector according to claim 5, wherein the first signal connecting means is coupled to the hook connector connecting part in a vertical direction or a horizontal direction.

7. The velcro connector according to claim 5, wherein the second signal connecting means is coupled to the loop connector connecting part in a vertical direction or a horizontal direction.

8. The velcro connector according to claim 5, wherein in the hook, holes are formed at a position corresponding to the hook connector connecting part and in the loop, holes are formed at a position corresponding to the loop connector connecting part.

9. The velcro connector according to claim 5, wherein the first signal connecting means is coupled to be protruded to the hook connector body.

10. The velcro connector according to claim 5, wherein the second signal connecting means is coupled to be protruded to the loop connector body.

11. The velcro connector according to claim 5, wherein a circuit module is coupled to one surface of the hook connector or the loop connector.

* * * * *